United States Patent [19]

Tucker

[11] Patent Number: 5,054,640

[45] Date of Patent: Oct. 8, 1991

[54] PROTECTIVE CAP FOR BEVERAGE CONTAINERS

[76] Inventor: Terence Tucker, 33811 Shannon La., San Juan Capistrano, Calif. 92675

[21] Appl. No.: 598,175

[22] Filed: Oct. 15, 1990

[51] Int. Cl.[5] ..... A47G 19/22; B65D 51/18

[52] U.S. Cl. ..... 220/90.2; 220/254; 220/307; 220/338

[58] Field of Search ..... 220/90.2, 90.4, 90.6, 220/254, 307, 338; 206/151

[56] References Cited

U.S. PATENT DOCUMENTS

| | | | |
|---|---|---|---|
| 2,754,866 | 7/1956 | Coltman, Jr. | 220/254 X |
| 2,764,199 | 9/1956 | Tupper | 220/254 |
| 3,202,448 | 8/1965 | Stern et al. | 206/151 |
| 3,250,564 | 5/1966 | Stern et al. | 206/151 X |
| 3,372,832 | 3/1968 | Yeater et al. | 220/254 |
| 3,737,066 | 6/1973 | Ames | 220/254 |
| 4,869,389 | 9/1989 | Cerrone, Jr. | 220/90.2 |
| 4,961,510 | 10/1990 | Dvoracek | 220/90.4 |

*Primary Examiner*—Stephen P. Garbe
*Assistant Examiner*—Nova Stucker
*Attorney, Agent, or Firm*—Stetina and Brunda

[57] ABSTRACT

A protective cap for canned soft drinks and the like is disclosed. The cap comprises an outer periphery configured to receive and snap over the upper surface of a conventional soft drink beverage can. A lip guard extends axially downward from the cap to provide a sanitary drinking surface. A grate is positioned to cover the opening in the top of the can through which the beverage may be consumed. The grate is formed as an integral portion of the molded cap. A hinged cover can rotate between opened and closed positions to permit consumption of the soft drink when in the opened position and to seal the container to prevent contamination from airborne debris and small insects when in the closed position. A detent formed upon the lower surface of the cover is received between adjacent bars of the grate to latch the cover in the closed position.

9 Claims, 2 Drawing Sheets

PROTECTIVE CAP FOR BEVERAGE CONTAINERS

FIELD OF THE INVENTION

The present invention relates generally to caps for beverage containers, and more particularly to a protective cap for canned soft drinks and the like.

BACKGROUND OF THE INVENTION

Protective caps which prevent insects and other contamination from entering beverage containers while permitting consumption of the beverage contained therein are well known. A grating or similar set of apertures typically permits consumption of the beverage while preventing bees and other insects, lured by the sugar content of the beverage, from entering the container. Such prior art protective caps generally snap over the upper end of a soft drink container such that an opening defined by the grate is positioned directly over the opening in the container. Thus, the user can consume the beverage by drinking the liquid directly from the container through the protective cover.

The problem of insects, particularly bees, entering sugar-sweetened soft drinks and the like is common, particularly when such soft drinks ar consumed outdoors. Besides being unappetizing and generally ruining the soft drink, such occurrences can be dangerous in that they may result in a bee sting or other insect bite or sting. In fact, there are cases where a bee sting inside the mouth or throat of a user has caused death.

While such prior art protective covers do serve adequately to prevent bees and other large insects from entering the beverage container, they are inadequate in preventing smaller insects, e.g. ants, mosquitos, and gnats, from entering the can. Such prior art protective covers are also incapable of preventing airborne contamination such as wind-blown dust, dirt, and the like from entering the beverage container. Thus, while such prior art devices have proven generally acceptable for their intended purposes, they possess inherent deficiencies which detract from their overall effectiveness in the marketplace.

SUMMARY OF THE INVENTION

The present invention specifically addresses and alleviates the above-mentioned deficiencies associated in the prior art. More particularly, a protective cap for canned soft drinks and the like is disclosed. The cap comprises an outer periphery configured to receive and snap over the upper surface of a soft drink can to be frictionally retained thereon. A lip guard extends axially downward from the cap for approximately five-eighths of an inch to provide a sanitary drinking surface. A grate is positioned to cover the opening in the top of the can through which the beverage may be consumed. The grate is formed as an integral portion of the molded cap. A hinged cover is pivotable between opened and closed positions to permit consumption of the soft drink when in the opened position and to seal the container to prevent contamination from airborne debris and small insects when in the closed position. A detent or latch formed upon the lower surface of the cover is received between adjacent bars of the grate to latch the cover in the closed position.

The grate is configured to permit substantially unrestricted flow of the beverage from the container while preventing most common larger insects from being able to enter the container. This eliminates the possibility of bee stings to the user's mouth and throat resulting from the consumption of a bee.

The hinged cover likewise prevents smaller insects as well as wind-blown debris from entering the container. Thus, the user may place the cover in a closed position and leave the soft drink unattended without the fear that ants or the like may crawl therein or that wind-blown dirt or the like may contaminate the beverage.

The hinged cover is particularly beneficial when consuming canned beverages at the beach where sand is likely to be blown or kicked upon the beverage container. Such occurrences are quite common when a beverage container is placed upon the sandy surface of the beach.

Thus, the protective cap of the present invention protects the user from ingestion of such debris and also prevents the waste of the contained beverage. Additionally, severe injuries and possibly death may be prevented by keeping these and other dangerous contaminants out of the beverage container. Further, the lip guard provides a sanitary surface from which the user may drink the beverage.

DETAILED DESCRIPTION OF THE PREFERRED EMBODIMENT

Figure 1:
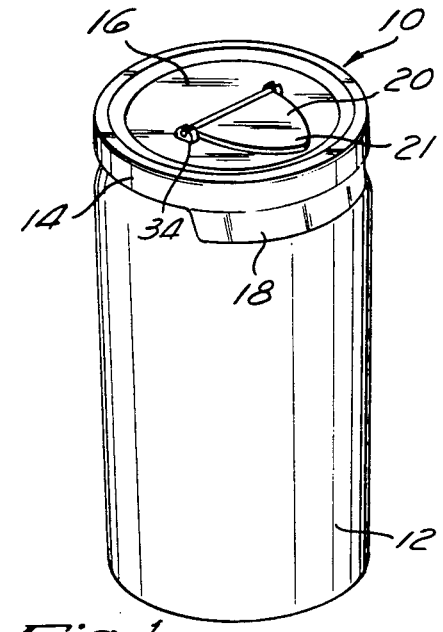
FIG. 1 is a perspective view of a beverage container having a protective cap of the present invention installed thereon.

The detailed description set forth below in connection with the appended drawings is intended as a description of the presently preferred embodiment of the invention, and is not intended to represent the only form in which the present invention may be constructed or utilized. The description sets forth the functions and sequences of steps for constructing and operating the invention in connection with the illustrated embodiments. It is to be understood, however, that the same or equivalent functions and sequences may be accomplished by different embodiments that are also intended to be encompassed within the spirit and scope of the invention.

The protective cap of the present invention is illustrated in FIGS. 1–7 which depict a presently preferred embodiment of the invention. Referring now to FIGS. 1–4, the protective cap 10 is removably attached to a conventional soft drink, beer, or the like container 12 (such as an aluminum beverage can) and is generally comprised of a outer periphery 14, top planar surface 16, hinged cover 20, and grate 24. The protective cap 10 is sized and configured to receive and snap over the upper lip 42 (shown in FIGS. 4 and 5) of a soft drink container 12 and thereby be frictionally retained thereon.

A lip guard 18 extends axially downward from the outer periphery 14 to provide a sanitary drinking surface such that the user's mouth need not come into direct contact with the beverage container 12. A grate 24 is disposed within an opening 46 through which the beverage may be ingested.

A detent post 28 formed upon the hinged cover 20 is received between adjacent bars 25 of the grate 24 which form aperture 26. The diameter of the detent pin 28 is sized slightly larger than the distance between adjacent bars 25 whereby the detent pin 28 therefore functions in combination with aperture 26 to form a latch which frictionally secures cover 20 in the closed position.

The bars 25 of the grate 24 are approximately one-sixteenth of an inch in width and spaced approximately one-sixteenth of an inch apart. Diagonal cross members 23 provide structural support to the bars 25 to prevent their inadvertent distortion during use and to maintain the rigidity required such that aperture 26 will function in combination with detent pin 28 to latch the hinged cover 20 in the closed position.

Pivot pins 22 formed upon either side of the proximal end of cover 20 are received by sockets 34 formed upon the upper surface 16 of the protective cap 10 such that the cover 20 may be hingeably rotated between opened and closed positions.

In the preferred embodiment of the present invention, openings 35 formed in the upper-most portion of the sockets 34 permit the pivot pins 22 to be snapped therein during assembly.

Figure 2:
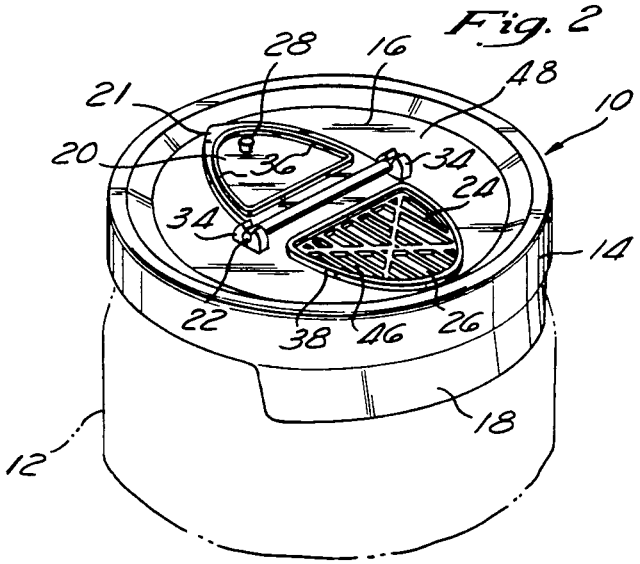
FIG. 2 is an enlarged perspective view of the protective cap of FIG. 1.
Figure 3:
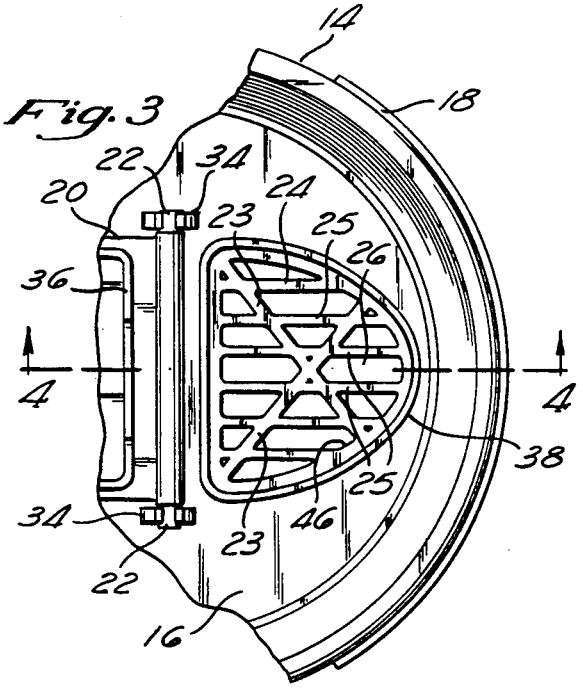
FIG. 3 is an enlarged sectional top plan view of the grate of the protective cap of FIG. 2.
Figure 4:
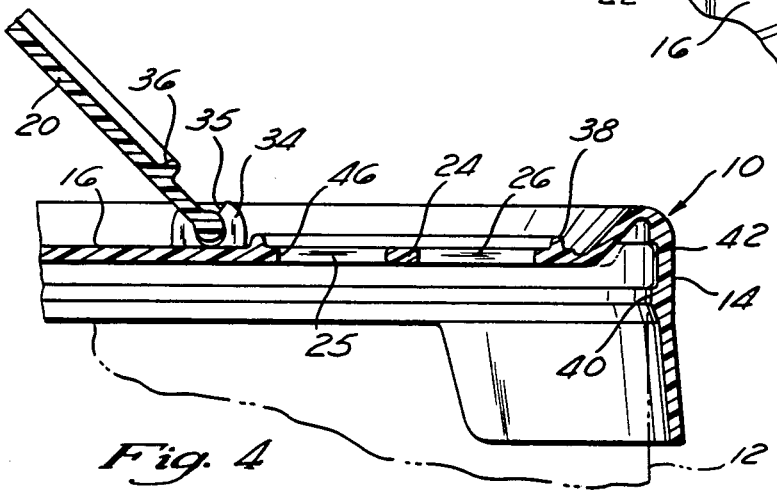
FIG. 4 is a cross-sectional side view of the protective cap of the present invention.

Thus, the hinged cover 20 may be rotated to an opened position, as illustrated in FIGS. 2–4, such that the user may pour or drink the beverage from the container 12. To prevent small insects and airborne debris from entering the container 12, the hinged cover 20 may be disposed in a closed position as illustrated in FIG. This is accomplished by simply manually rotating the hinged cover 20 down over the grate 24 and snapping it into place. Snapping the hinged cover 20 into the closed position causes the detent pin 28 to be frictionally received by the aperture 26 formed in the grate 24 and to be removably captured therein. The two bars 25 on either side of the aperture 26 frictionally engage and hold the detent pin 28 such that the hinged cover 20 remains in the closed position until manually opened by the user. The distal end of the detent pin 28 may be flaired slightly to facilitate engagement with the bars 25. To open the hinged cover 20, the user simply inserts the tip of a finger, or a fingernail, beneath the distal end 21 of the hinged cover 20 and then pries the hinged cover upward to disengage the detent pin 22 from the two bars 25 of the grate 24.

With particular reference to FIG. 4, the protective cover 10 of the present invention is removably attached to a beverage container 12 by placing the protective cap 10 atop the beverage container 12, as shown in FIGS. 1–3 and pressing firmly axially downward. This action causes the annular cap detent 40 formed upon the inner surface of the outer periphery 14 of the cap 10 to engage the lip 42 of the beverage container 12. Thus, the protective cap 10 of the present invention snaps firmly into place where it will remain until manually detached.

A lip 36 formed upon the cover 20 cooperates with a lip 38 formed upon the planar surface 16 around the aperture 46 (best shown in FIG. 2) to seal the container 12 such that small insects and wind-blown debris cannot enter the container 12 when the cover 20 is in the closed position.

Figure 5:
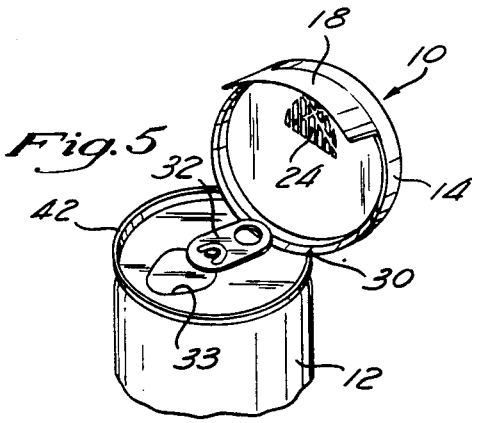
FIG. 5 illustrates the use of the protective cap of the present invention in the opening a pop-top beverage container.

Referring now to FIG. 5, the peripheral lip 30 of the protective cap 10 of the present invention is specifically formed to be used to pry the key 32 of the beverage container 12 upward in order to open the beverage container 12. This is particularly advantageous due to the difficulties occasionally encountered, particularly by women with long and/or artificial fingernails, in opening such containers. Small children also experience difficulty in opening such containers. Thus, the protective cap of the present invention provides a simple and convenient means of opening pop-top containers in addition to preventing the contamination of the contents of such containers.

Figure 6:
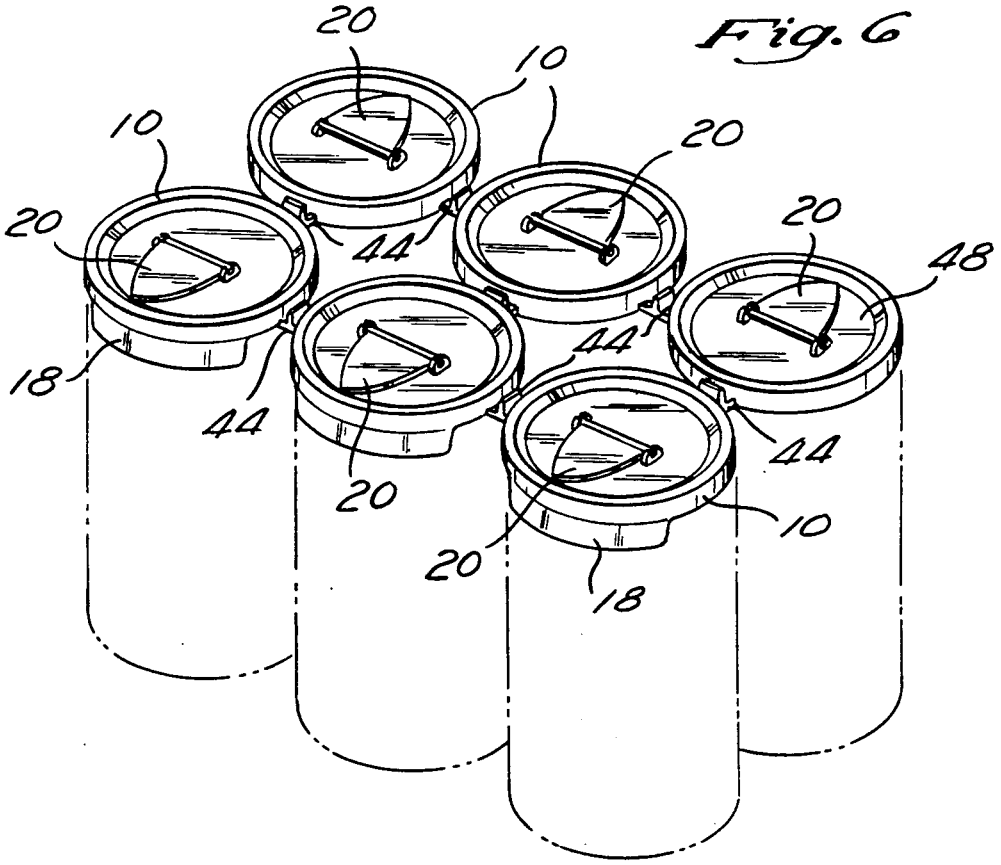
FIG. 6 is a perspective view of a six-pack beverage package formed using a plurality of protective caps of the present invention.
Figure 7:
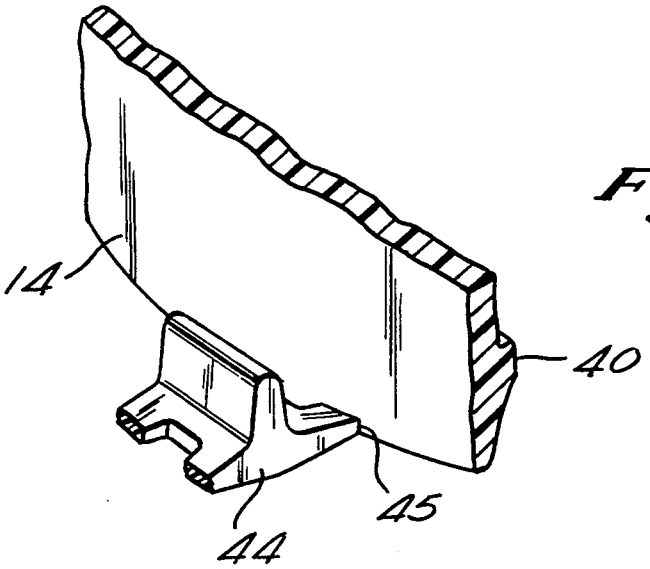
FIG. 7 is an enlarged sectional view of the connecting links of FIG. 6.

Referring now to FIGS. 6 and 7, a plurality of protective caps 10 of the present invention may be formed in an array such that they serve to form a package or six-pack carrier. Thus, beverages may be sold with protective caps 10 attached such that they both form a package carrier and provide a premium to the customer. Connecting links 44 attach each protective cap 10 to at least two adjacent protective caps 10 such that a plurality of such attached beverage containers may be carried and handled as a unit. The connecting links 44 are formed to have a weak area at the innerface 45 to the outer periphery 14 of the cap 10 such that they will detach therefrom when a deliberate attempt is made to forcibly remove one beverage container 12 from the remainder, yet remain intack during normal articulation such that a user may carry a conventional six-pack merely by grasping the protective cap array.

The protective caps 10 of FIGS. 6 and 7 may be formed without the hinged cover 20 to facilitate the stacking of containers having the protective caps 10 installed thereon. Forming protective caps 10 without hinged covers 20 permits the bottom of a container 12 to be received by the recess 48 formed in the upper surface of the protective cap 10. Thus, forming the protective cap 10 without the hinged cover permits vertical stacking of a plurality of containers wherein lateral slipping is reduced by the fit of the bottom of each upper container into the protective cap of each lower container.

The protective cap 10 of the present invention is preferably formed by the injection molding of plastic. The cap 10 and cover 20 are formed as separate pieces which are then assembled to provide the protective cap 10 of the present invention. Assembly requires only the snapping of the pivot pins 22 into their respective sockets 34.

It is understood that the exemplary protective cap described herein and shown in the drawings represents only a presently preferred embodiment of the invention. Indeed, various modifications and additions may be made to such embodiment without departing from the spirit and scope of the invention. For example, the size and shape of the opening 46 and hinged cover 20 need not conform substantially to the size and shape of the opening 33 which is formed in the beverage container 12. Rather, those skilled in the art will recognize that various sizes and shapes are likewise suitable. Also, the precise configuration of the lip guard 18 is not crucial to the practice of the present invention. Any configuration that permits the user to drink from the beverage container without permitting his mouth to directly contact the container 12 is suitable. Thus, these and other modifications and additions may be obvious to those skilled in the art and may be implemented to adapt the present invention for use in a variety of different applications.

What is claimed is:

1. A protective cap for preventing insects, airborne debris, and the like from entering beverage containers, the cap comprising:

(a) a generally planar surface;

(b) a peripheral portion formed substantially perpendicular to said planar surface at the periphery of said planar surface, said peripheral portion having a detent formed thereon for releasably attaching the protective cap to a beverage container;

(c) an opening formed in said planar surface;

(d) a grate formed within said opening; and (e) a cover hingeably attached to said planar surface such that said cover can be rotated between an opened position and a closed position; and (f) a detent pin formed upon the lower surface of said cover; and (g) wherein said detent pin engages said grate when said cover is in the closed position, said detent pin and said grate cooperating to latch said cover in the closed position.

2. The protective cap as recited in claim 1 wherein said grate is sized and configured such that fluid flows substantially unrestricted therethrough and such that bees cannot pass therethrough.

3. The protective cap as recited in claim 2 further comprising a lip guard formed about a portion of the periphery of said planar surfaces.

4. The protective cap as recited in claim 3 wherein said grate is comprised of alternating bars and apertures, said bars being approximately 0.0625 inch wide and said apertures being approximately 0.06215 inch wide.

5. The protective cap as recited in claim 4 further comprising:

(a) a first lip formed upon said planar surface;

(b) a corresponding second lip formed up said cover; and (c) wherein said first and second lips cooperate to seal said opening when said cover is disposed in the closed position.

6. The protective cap as recited in claim 5 further comprising a plurality of connecting links for attaching a plurality of protective caps together, each connecting link attaching the protective caps together such that the protective caps may be separated by manual force.

7. A protective cap and packaging device for beverage containers, said device comprising:

(a) a plurality of generally planar surfaces;

(b) a peripheral portion formed substantially perpendicular to each of said planar surfaces at the periphery of each of said planar surfaces, each of said peripheral portions having a detent formed thereon for releasably attaching the protective cap to a beverage container;

(c) an opening formed in said planar surface;

(d) a grate formed within said opening;

(e) a cover hingeably attached to said planar surface such that said cover can be rotated between an opened position and a closed position; and (f) a plurality of connecting links formed intermediate said planar surfaces for attaching said planar surfaces together such that said planar surfaces may be separated by manual force.

8. The protective cap and packaging device, as recited in claim 7, further comprising:

(a) a detent pin formed upon the lower surface of said covers; and (b) wherein said detent pins engage said grates when said covers are in the closed position, said detent pins and said grates cooperating to latch said covers in the closed position.

9. A protective cap and packaging device for beverage containers, said device comprising:

(a) a plurality of generally planar surfaces;

(b) a peripheral portion formed substantially perpendicular to each of said planar surfaces at the periphery of each of said planar surfaces, each of said peripheral portions having a detent formed thereon for releasably attaching the protective cap to a beverage container, said peripheral portions cooperating with said generally planar surfaces to form recesses sized and configured to receive the bottoms of beverage containers such that stacking is facilitated;

(c) an opening formed in said planar surfaces;

(d) a grate formed within said openings; and (e) a plurality of connecting links formed intermediate said planar surfaces for attaching said planar surfaces together such that said planar surfaces may be separated by manual force.

* * * * *